US012252859B2

(12) United States Patent
Rainey

(10) Patent No.: US 12,252,859 B2
(45) Date of Patent: Mar. 18, 2025

(54) MECHANICALLY STABILIZED EARTH (MSE) RETAINING WALL EMPLOYING REINFORCEMENT RODS

(71) Applicant: Earth Wall Products, LLC, Smyrna, GA (US)

(72) Inventor: Thomas L. Rainey, Marietta, GA (US)

(73) Assignee: EARTH WALL PRODUCTS, LLC, Smyrna, GA (US)

( * ) Notice: Subject to any disclaimer, the term of this patent is extended or adjusted under 35 U.S.C. 154(b) by 161 days.

(21) Appl. No.: 18/139,648

(22) Filed: Apr. 26, 2023

(65) Prior Publication Data

US 2024/0360642 A1 Oct. 31, 2024

(51) Int. Cl.
*E02D 29/02* (2006.01)
*E02D 17/20* (2006.01)

(52) U.S. Cl.
CPC ..... *E02D 29/0241* (2013.01); *E02D 29/0266* (2013.01); *E02D 2600/20* (2013.01); *E02D 2600/40* (2013.01)

(58) Field of Classification Search
CPC ..... E02D 29/0241; E02D 29/0233; E02D 29/0266
See application file for complete search history.

(56) References Cited

U.S. PATENT DOCUMENTS 4,834,584 A 5/1989 Hilfiker
5,807,030 A 9/1998 Anderson et al.
6,079,908 A * 6/2000 Anderson ..... E02D 29/02 405/262
7,722,296 B1 * 5/2010 Taylor ..... E02D 29/0233 405/262
10,577,772 B1 * 3/2020 Taylor ..... E02D 5/801
2007/0014638 A1 1/2007 Brown
2010/0247248 A1 * 9/2010 Taylor ..... E02D 5/76 405/262
2011/0229274 A1 * 9/2011 Taylor ..... B23K 11/002 405/262
2014/0003869 A1 * 1/2014 Freitag ..... E04C 5/12 405/262
2021/0340718 A1 * 11/2021 Taylor ..... E02D 29/0233

OTHER PUBLICATIONS

PCT Search Report in related PCT Application No. PCT/US2023/077931, mailed Mar. 3, 2024.

* cited by examiner

*Primary Examiner* — Frederick L Lagman
*Assistant Examiner* — Stacy N Lawson
(74) *Attorney, Agent, or Firm* — Thomas | Horstemeyer, LLP

(57) ABSTRACT

Disclosed are embodiments of a mechanically stabilized earth (MSE) retaining wall that employs one or more reinforcement rods and that can be produced with inexpensive, widely available parts. A concrete panel is provided. A steel connector is provided with a loop and first and second stems. The loop is secured within the concrete panel. The first and second stems are secured to and extend in a linear manner outwardly from the loop. Each of the stems has a circular aperture, which are aligned. A steel reinforcement rod is provided within backfill soil. A steel threaded attachment rod is secured to and extends perpendicular from the reinforcement rod. The attachment rod also extends through the circular apertures of the connector. A screw nut is threaded on the attachment rod to thereby secure together the stems and the reinforcement rod.

16 Claims, 4 Drawing Sheets

TOP VIEW

MECHANICALLY STABILIZED EARTH (MSE) RETAINING WALL EMPLOYING REINFORCEMENT RODS

FIELD OF THE INVENTION

The present invention generally relates to modular earth retaining walls, and more particularly, to mechanically stabilized earth (MSE) retaining walls.

BACKGROUND OF THE INVENTION

Modular earth retaining walls with concrete panels are commonly used for architectural and site development applications. Such walls are subjected to very high pressures exerted by lateral movements of the soil, temperature and shrinkage effects, and seismic loads.

In many commercial applications, for example, along or supporting highways, etc., each concrete panel can weigh between two and five thousand pounds and have a front elevational size of about eight feet in width by about five feet four inches in height.

Oftentimes, the earth retaining walls of this type are reinforced. More specifically, a conventional mechanically stabilized earth (MSE) retaining wall with steel reinforcement is typically reinforced with steel strips or welded wire meshes that extends backward, or perpendicular, from the rear of a concrete panel to reinforce the backfill soil.

The inventor of the present application filed a patent application Ser. No. 17/380,697 on Jul. 20, 2023, with a design for an MSE retaining wall with reinforcement rods having spaced pullout inhibiting structures (e.g., round planar disks), which application is incorporated herein by reference in its entirely. Although this design tested well in field tests and had significant merit, it undesirably employed specially made parts that resulted in high cost as well as difficulty in terms of installation.

Some of the significant challenges in this field of design are the cost and design complexity that oftentimes requires specially made parts that are not readily available. That is the focus of the present disclosure.

SUMMARY OF THE INVENTION

The present disclosure provides various embodiments of an inexpensive and effective mechanically stabilized earth (MSE) retaining wall that employ, for reinforcement, cylindrical rods and that can be produced from widely available parts.

One embodiment, among others, can be summarized as follows. A concrete panel is provided. A steel connector is also provided with a loop and first and second stems. The loop is secured within the concrete panel. The first and second stems are secured to and extend in a linear manner outwardly from the loop. Each of the stems has a circular aperture, which are aligned. A steel reinforcement rod, for example, rebar, is provided within backfill soil. A steel threaded attachment rod, for example, a coil thread insert, is secured to and extends perpendicular from the reinforcement rod. The attachment rod also extends through the circular apertures of the connector. A steel screw nut is threaded on the attachment rod to thereby secure together the stems and the reinforcement rod.

Other embodiments, apparatus, systems, methods, features, and advantages of the present disclosure will be or become apparent to one with skill in the art upon examination of the following drawings and detailed description. It is intended that all such additional embodiments, apparatus, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. The dimensions indicated in some of the figures are associated with a nonlimiting examples of an embodiment.

DETAILED DESCRIPTION OF PREFERRED EMBODIMENTS

Figure 1:
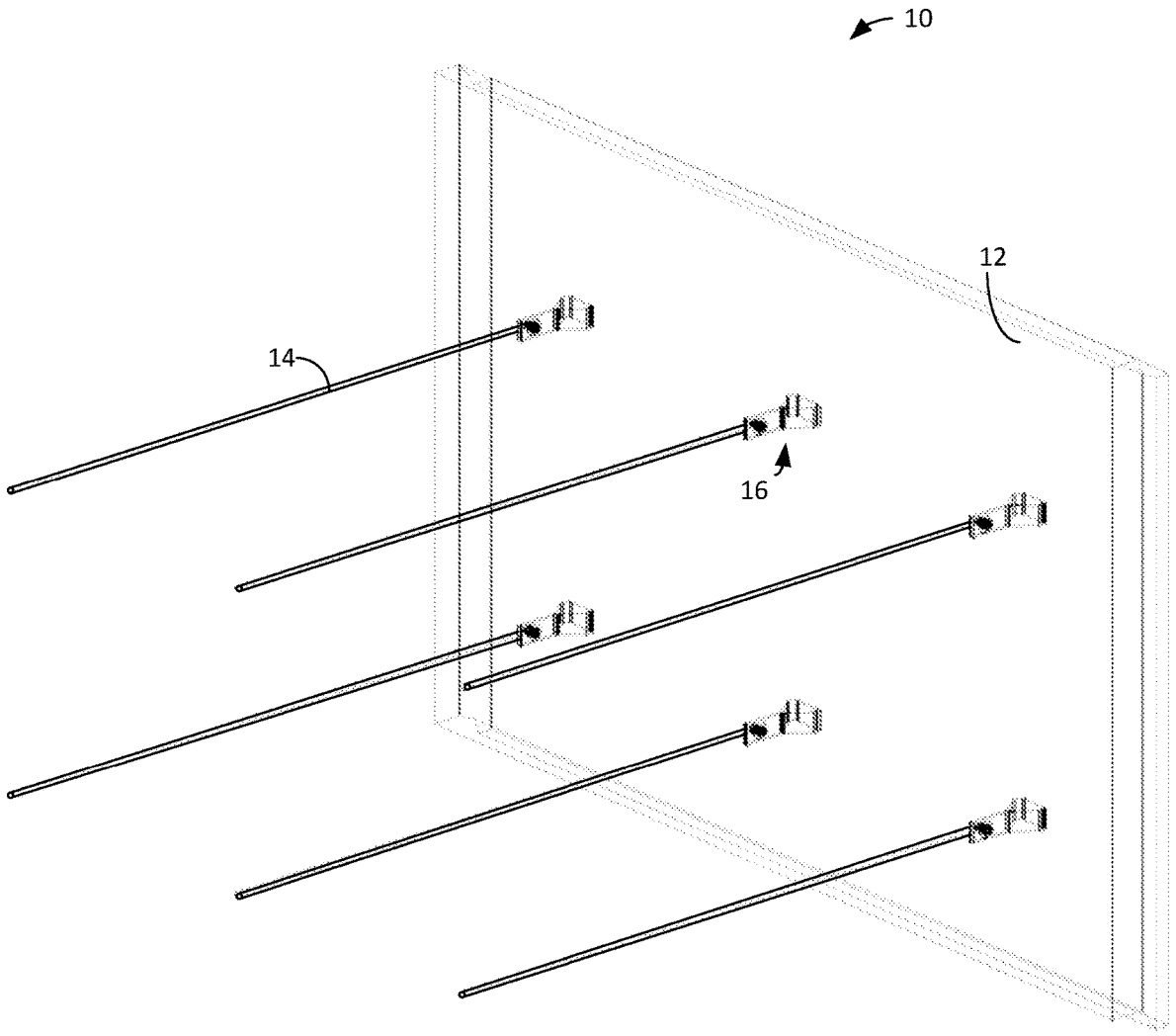
FIG. 1 is a perspective view of a mechanically stabilized earth (MSE) retaining wall employing one or more wall panels and one or more reinforcement rods in accordance with the present invention.
Figure 2:
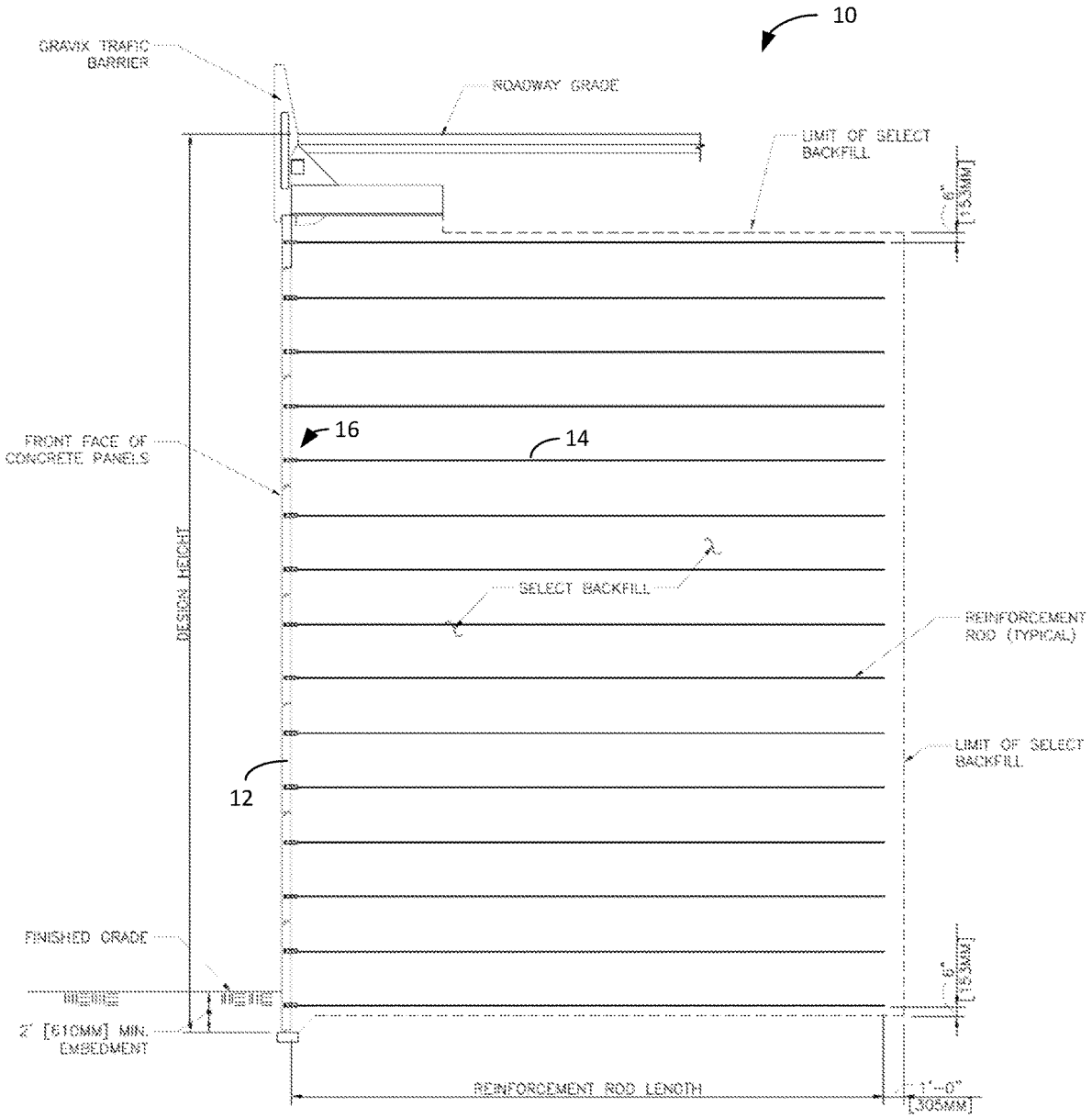
FIG. 2 is a side cross sectional view of the wall of FIG. 1.

FIGS. 1 and 2 show a mechanically stabilized earth (MSE) retaining wall 10 employing one or more modular concrete wall panels 12 and one or more elongated cylindrical steel reinforcement rods 14 in accordance with the present invention. The wall 10 can be produced with inexpensive, widely available parts and will have a lifespan of at least one hundred years, as is required by regulations in most governmental jurisdictions.

As illustrated, the concrete wall panel 12 has a generally planar body with a frontside, a backside, and a surrounding peripheral edge.

The reinforcement rod 14 has a longitudinal body with first and second ends with the first end residing with the backfill soil and the second end being secured within a wall panel 12. The second end is secured within the wall panel 12 when the wall panel 12 is cast. Although not required, each rod 14 preferably comprises raised ribs along its longitudinal body. In the preferred embodiment, each rod 14 is standard rebar, which is inexpensive and widely available.

Figure 3B:
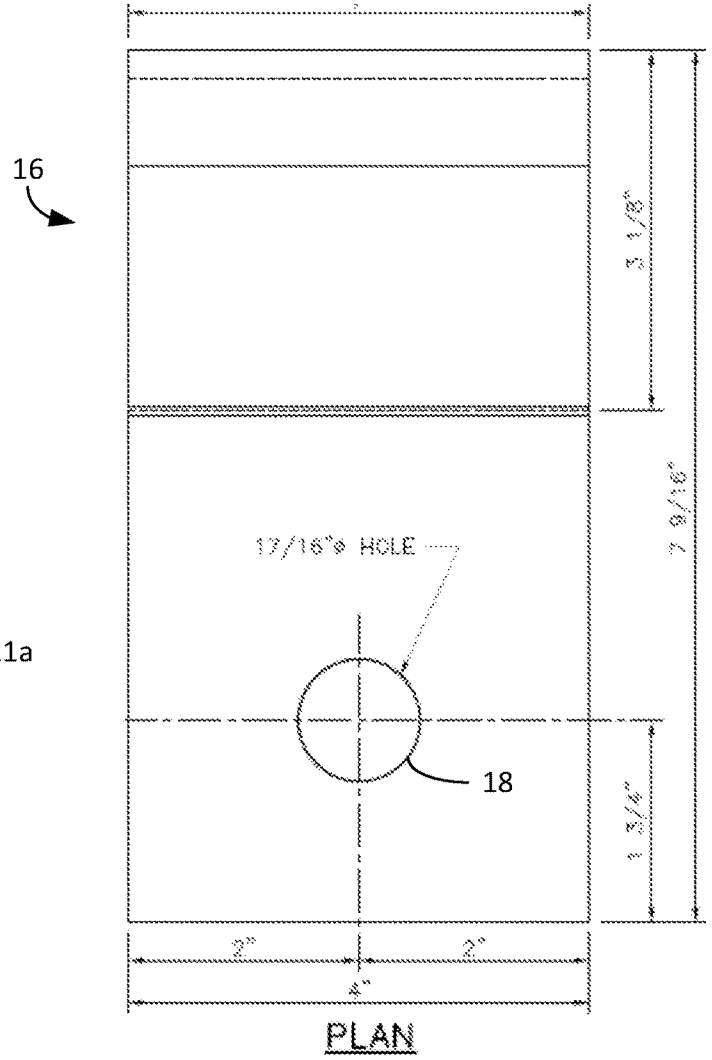
FIG. 3B is a top view of the connector of FIG. 3B.
Figure 3A:
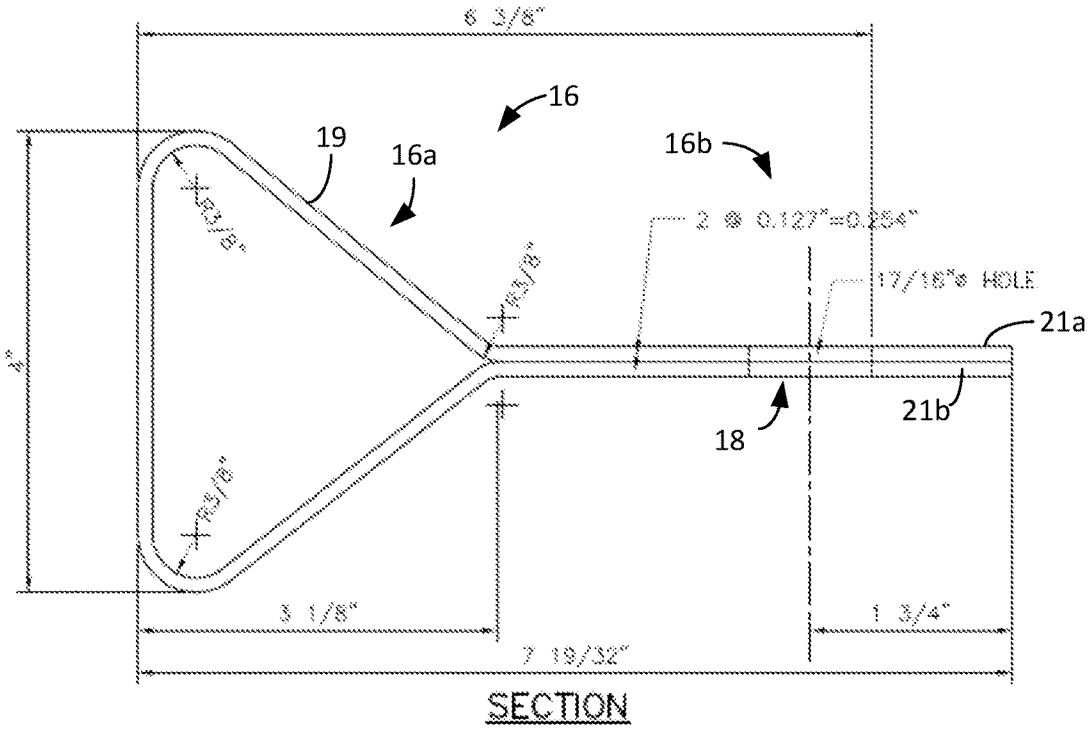
FIG. 3A is a side cross sectional view of a widely available connector of FIG. 1 designed to attach a wall panel of the wall to a reinforcement rod.

As shown in FIGS. 3A and 3B, a steel connector 16 is used to connect the panel 12 to a reinforcement rod 14. Each connector 16 has interconnected first and second parts 16*a*, 16*b*. The first part 16*a* is secured to and within the concrete panel 12. The second part 16*b* extends outwardly from the backside of the wall panel 12. The second part 16*b* has a circular aperture 18. The circular aperture 18 has a central axis that extends generally parallel to the backside of the panel 12.

In the preferred embodiment, the first part 16*a* of the connector 16 is a triangular-shaped steel loop 19, and the second part 16*b* comprises first and second stems 21*a*, 21*b* secured to and extending in a linear manner outwardly from the steel loop 19. Each of the stems 21*a*, 21*b* has opposing first and second generally flat sides extending between first and second edges and having the circular aperture 18. The first side of the first stem 21*a* being contiguous with the second side of the second stem 21*b*. Moreover, the circular apertures 18 of the stems 21*a*, 21*b* are substantially aligned with each other. Furthermore, because the first and second stems 21*a*, 21*b* a contiguous (with no separation), no concrete gets in between them when concrete is poured to cast the panel 12.

In this preferred embodiment, the loop 19 and stems 21*a*, 21*b* are formed from a singular elongated steel plate having opposing first and second generally flat sides extending between left and right edges and first and second ends, the loop being triangular in shape, the first and second stems formed by respective longitudinal parts near the first and second ends of the steel plate. The widely available connector 16 is machine produced in mass and readily available for flat plate steel strips and/or welded wire mesh, which are commonly used with MSE wall structures. The current invention involves the unique method of attaching the common, machine produced connector to an unconventional round reinforcement rod 14.

In alternative embodiments, the connector 16 may have only a single stem extending from the loop 19.

In yet other embodiments, the loop 19 of the connector 16 could have a different shape, for example, T-shaped, circular, irregular, partial loop, linear, non-symmetrical, etc.

Figure 4B:
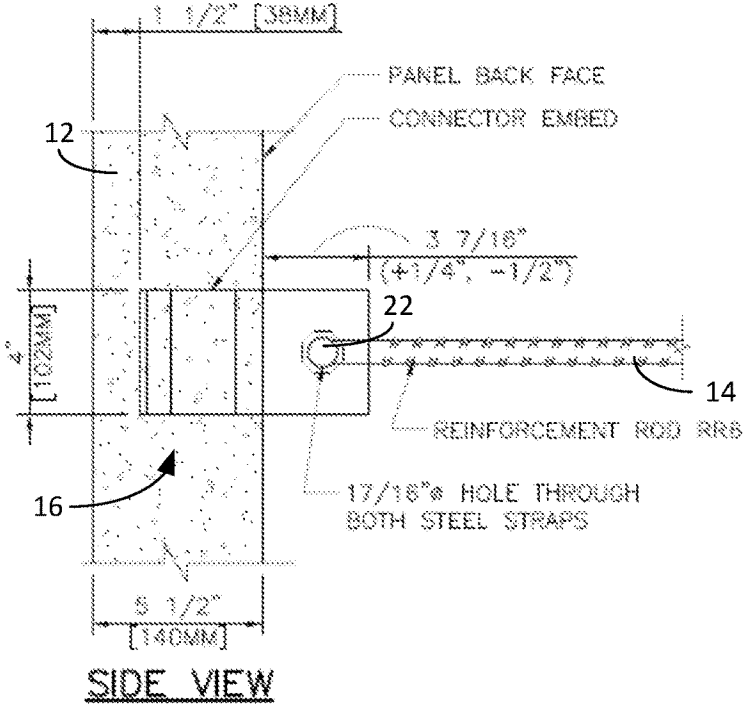
FIG. 4B is a side cross sectional view of the configuration of FIG. 4A.
Figure 4A:
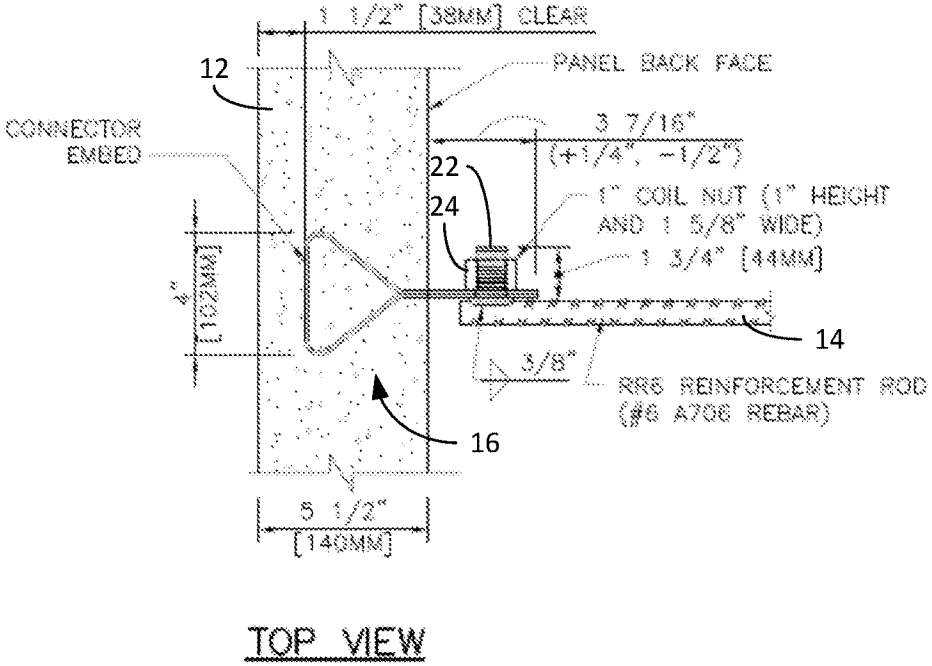
FIG. 4A is a top cross sectional view of the wall panel, connector, and reinforcement rod in a connected configuration.

As illustrated in FIGS. 4A and 4B, a steel threaded attachment rod 22 is designed to connect the reinforcement rod 14 to the connector 16. The attachment rod 22 has a generally cylindrical elongated body with first and second ends. The first end of the attachment rod 22 is secured to and extends generally perpendicular from the reinforcement rod 14 at a location in close proximity to the second end of the reinforcement rod 14. In the preferred embodiment, the attachment rod 22 is a coil thread insert, which is inexpensive and widely available, and the coil thread insert 22 is welded to the reinforcement rod 14 using a conventional stud welder or other suitable welding apparatus. In alternative embodiments, the attachment rod 22 could be a bolt or threaded part of a bolt that is welded to the reinforcement rod 14. The threaded attachment rod 22 extends through the circular aperture 18 of the steel connector 16, and a standard steel screw nut 24 is threaded on the attachment rod 22 to thereby secure together the connector 16 and the reinforcement rod 14.

Finally, many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

The invention claimed is:

1. A mechanically stabilized earth (MSE) retaining wall, comprising:

a concrete panel, the panel having a generally planar body with a frontside, a backside, and a surrounding peripheral edge;

a steel connector having first and second parts, the first part residing and secured within the concrete panel, the second part extending outwardly from the backside, the second part having an aperture;

a steel reinforcement rod, the rod having a generally cylindrical elongated body with first and second ends, the first end residing within backfill soil;

a steel threaded attachment rod having a generally cylindrical elongated body with first and second ends, the first end of the attachment rod welded to and extending generally perpendicular from the reinforcement rod at a location proximate to the second end of the reinforcement rod, the attachment rod extending through the aperture of the connector; and a steel screw nut that is threaded on the attachment rod to thereby secure together the steel connector and the reinforcement rod.

2. The wall of claim 1, wherein the steel reinforcement rod comprises a plurality of raised ribs along its elongated body.

3. The wall of claim 2, wherein the steel reinforcement rod is rebar.

4. The wall of claim 1, wherein the aperture is circular and wherein the circular aperture has a central axis that extends generally parallel to the backside of the panel.

5. The wall of claim 1, wherein the first part of the connector is a steel loop and the second part comprises first and second stems secured to and extending in a linear manner outwardly from the steel loop, each of the stems having opposing first and second generally flat sides extending between first and second edges and having first and second circular apertures, the first side of the first stem being contiguous with the second side of the second stem, the circular apertures being substantially aligned to create the circular aperture.

6. A mechanically stabilized earth (MSE) retaining wall, comprising:

a concrete panel, the panel having a generally planar body with a frontside, a backside, and a surrounding peripheral edge;

a steel connector having a loop and first and second stems, the loop secured to the concrete panel, the first and second stems secured to and extending in a linear manner outwardly from the loop, each of the stems having opposing first and second generally flat sides extending between first and second edges and having a circular aperture, the first side of the first stem being contiguous with the second side of the second stem, the circular apertures being aligned;

a steel reinforcement rod, the rod having a generally cylindrical elongated body with first and second ends, the first end residing within backfill soil;

a steel threaded attachment rod having a generally cylindrical elongated body with first and second ends, the first end of the attachment rod welded to and extending generally perpendicular from the reinforcement rod at a location proximate to the second end of the reinforcement rod, the attachment rod extending through the aligned circular apertures; and a screw nut that is threaded on the attachment rod to thereby secure together the stems and the reinforcement rod.

7. The wall of claim 6, wherein the loop and stems are formed from a singular elongated steel plate having opposing first and second generally flat sides extending between left and right edges and first and second ends, the loop being triangular in shape, the first and second stems formed by respective longitudinal parts near the first and second ends of the steel plate.

8. The wall of claim 6, wherein the steel reinforcement rod comprises a plurality of raised ribs along its elongated body.

9. The wall of claim 8, wherein the steel reinforcement rod is rebar and the attachment rod is a coil thread insert.

10. The wall of claim 6, wherein each of the circular apertures has a central axis that extends generally parallel to the backside of the panel.

11. A mechanically stabilized earth (MSE) retaining wall, comprising:

a concrete panel, the panel having a generally planar body with a frontside, a backside, and a surrounding peripheral edge;

a connector, the connector having a loop and a linearly extending stem part, the loop secured within the concrete panel, the stem part secured to and extending in a linear manner outwardly from the loop, the stem part having opposing first and second generally flat sides extending between first and second edges and having a circular aperture;

a steel reinforcement rod, the rod having a generally cylindrical elongated body with first and second ends, the first end residing within backfill soil;

a steel threaded attachment rod having a generally cylindrical elongated body with first and second ends, the first end of the attachment rod welded to and extending generally perpendicular from the reinforcement rod at a location proximate to the second end of the reinforcement rod, the attachment rod extending through the circular aperture of the connector; and a screw nut that is threaded on the attachment rod to thereby secure together the stem part and the reinforcement rod.

12. The wall of claim 11, wherein the stem part comprises first and second stem parts, each of the stem parts having opposing first and second generally flat sides extending between first and second edges and having respective first and second circular apertures, the first side of the first stem part being contiguous with the second side of the second stem part, the first and second circular apertures being aligned to create the circular aperture.

13. The wall of claim 12, wherein the loop and stem parts are formed from a singular elongated steel plate having opposing first and second generally flat sides extending between left and right edges and first and second ends, the loop being triangular in shape, the first and second stem parts formed by respective longitudinal parts near the first and second ends of the steel plate.

14. The wall of claim 11, wherein the steel reinforcement rod comprises a plurality of raised ribs along its elongated body.

15. The wall of claim 14, wherein the steel reinforcement rod is rebar and the attachment rod is a coil thread insert.

16. The wall of claim 11, wherein the circular aperture has a central axis that extends generally parallel to the backside of the panel.

* * * * *